US007005999B2

(12) United States Patent
Salzhauer et al.

(10) Patent No.: US 7,005,999 B2
(45) Date of Patent: Feb. 28, 2006

(54) PERSONAL MONITORING SYSTEM

(76) Inventors: Michael Alexander Salzhauer, 9241 Byron Ave., Surfside, FL (US) 33154; Leora Sarah Salzhauer, 165 Cowpens Dr., Orangeburg, NY (US) 10962

( * ) Notice: Subject to any disclaimer, the term of this patent is extended or adjusted under 35 U.S.C. 154(b) by 323 days.

(21) Appl. No.: 10/612,982

(22) Filed: Jul. 7, 2003

(65) Prior Publication Data

US 2004/0137959 A1 Jul. 15, 2004

Related U.S. Application Data

(63) Continuation-in-part of application No. 10/382,865, filed on Mar. 7, 2003.

(60) Provisional application No. 60/440,052, filed on Jan. 15, 2003.

(51) Int. Cl.
*G08B 21/00* (2006.01)

(52) U.S. Cl. ..... 340/686.1; 340/286.05; 340/286.11; 340/539.8; 340/568.1; 340/628

(58) Field of Classification Search ..... 340/686.1, 340/628, 632, 539.23, 573.1, 573.4, 568.1, 340/568.2, 321, 574, 407.1, 287, 568.8, 286.05, 340/286.11, 539.1, 692, 686.6, 665, 666, 340/539.17, 539.18, 575

See application file for complete search history.

(56) References Cited

U.S. PATENT DOCUMENTS

| | | | | |
|---|---|---|---|---|
| 3,952,294 A | | 4/1976 | Emerson et al. | |
| 4,093,944 A | * | 6/1978 | Muncheryan | 340/521 |
| 4,160,246 A | | 7/1979 | Martin et al. | |
| 4,363,031 A | | 12/1982 | Reinowitz | |
| 4,410,883 A | | 10/1983 | Swiston, Sr. | |
| 4,453,222 A | | 6/1984 | Goszyk | |
| 4,617,555 A | | 10/1986 | Sheiman | |
| 4,623,878 A | | 11/1986 | Schoenwetter | |
| 4,893,324 A | | 1/1990 | Scown | |
| 4,896,145 A | | 1/1990 | Lewkowicz | |
| 4,904,988 A | | 2/1990 | Nesbit et al. | |
| 5,019,805 A | | 5/1991 | Curl et al. | |
| 5,159,315 A | | 10/1992 | Schultz et al. | |
| 5,349,338 A | * | 9/1994 | Routman et al. | 340/692 |
| 5,587,705 A | | 12/1996 | Morris | |
| 5,594,422 A | | 1/1997 | Huey, Jr. et al. | |
| 5,625,345 A | | 4/1997 | Stark et al. | |
| 5,651,070 A | | 7/1997 | Blunt | |
| 5,663,714 A | * | 9/1997 | Fray | 340/692 |
| 5,726,629 A | | 3/1998 | Yu | |

(Continued)

*Primary Examiner*—Davetta W. Goins
(74) *Attorney, Agent, or Firm*—Kenyon & Kenyon

(57) ABSTRACT

A method for alerting and monitoring a quiescent person may include recording a personal alert message and, in response to receiving an alarm, playing the personal alert message, detecting the removal of a safety device from a cradle and, in response, sending a message to a remote monitoring system. A system for alerting and monitoring a quiescent person may include a cradle to transmit a safety device absent signal, a communications interface to send a safety device absent message to a remote monitoring system, an audio input to record a personal alert message, playback the personal alert message, and transmit an alert signal in response to the detection of an audible alarm, an audio output, coupled to the audio input, to play the personal alert message through a speaker, and a processor, coupled to the cradle, the communications interface, the audio input, the audio output, and a power supply. The processor may be adaptively configured to transmit the play signal in response to the alert signal, and transmit the safety device absent signal to the communications interface in response to the alert signal from the audio input and the safety device absent signal from the cradle.

29 Claims, 2 Drawing Sheets

U.S. PATENT DOCUMENTS 5,889,468 A * 3/1999 Banga ..... 340/628
6,002,921 A 12/1999 Phahlert et al.
6,043,750 A 3/2000 Mallory
6,052,052 A * 4/2000 Delmonaco ..... 340/539.11
6,078,269 A 6/2000 Markwell et al.
6,084,522 A 7/2000 Addy
6,087,933 A 7/2000 Addy et al.
6,097,288 A 8/2000 Koeppe, Jr.
6,239,704 B1 * 5/2001 Olson ..... 340/573.1
6,323,780 B1 * 11/2001 Morris ..... 340/692
6,377,172 B1 4/2002 Neer
6,380,860 B1 4/2002 Goetz
6,384,724 B1 5/2002 Landais
6,392,536 B1 5/2002 Tice et al.
6,420,973 B1 7/2002 Acevedo
6,441,731 B1 8/2002 Hess
6,518,878 B1 2/2003 Skoff
6,522,248 B1 * 2/2003 Andres et al. ..... 340/521
6,529,128 B1 3/2003 Weng
6,690,288 B1 * 2/2004 Waddell ..... 340/692
6,836,212 B1 * 12/2004 Sawinski ..... 340/539.23

* cited by examiner

PERSONAL MONITORING SYSTEM

CLAIM FOR PRIORITY

This non-provisional patent application is a continuation in part of U.S. patent application Ser. No. 10/382,865, filed Mar. 7, 2003, and claims the benefit of U.S. Provisional Patent Application Ser. No. 60/440,052, filed Jan. 15, 2003, which are both incorporated herein by reference in their entirety.

TECHNICAL FIELD

The present invention relates to a device and system for alerting a quiescent person to the presence of a dangerous condition, and monitoring the response of that person to the alert.

BACKGROUND OF THE INVENTION

Smoke, and gas, detectors are lifesaving devices that greatly increase the likelihood of surviving a fire in a building. Generally, these detection devices sense smoke, carbon dioxide or other noxious and toxic airborne substances, and, in response, sound a piercing alarm, or flash an intense strobe light, to alert the occupants of the building to the dangerous condition. For residential structures, the occupants may be sleeping and difficult to rouse. For example, young children often fail to wake during mock fire drills, due, in part, to their ability to fall asleep even in the noisiest environments. Older adults may also be insensitive to external environmental queues when sleeping.

The standard smoke detector's audible alarm often fails to wake these individuals quickly enough to avoid injury. In a building fire, or in other dangerous conditions, a device that quickly and consistently wakes up sleeping occupants may mean the difference between life and death. A remote indication that the individual has responded to the device may assist rescue personnel in their efforts as well.

DETAILED DESCRIPTION

In accordance with embodiments of the present invention, a method for alerting and monitoring a quiescent person may include recording a personal alert message and, in response to receiving an alarm, playing the personal alert message, detecting the removal of a safety device from a cradle and, in response, sending a message to a remote monitoring system. The safety device may be a flashlight, a cellular telephone, a walkie talkie, etc. In this manner, the quiescent person may respond to the personal alert message by removing the safety device from the cradle, which alerts the remote monitoring system, rescue personnel, etc., to the presence of that person within the building or location. A system for alerting and monitoring a quiescent may be described, in detail, with reference to FIG. 1.

Figure 1:
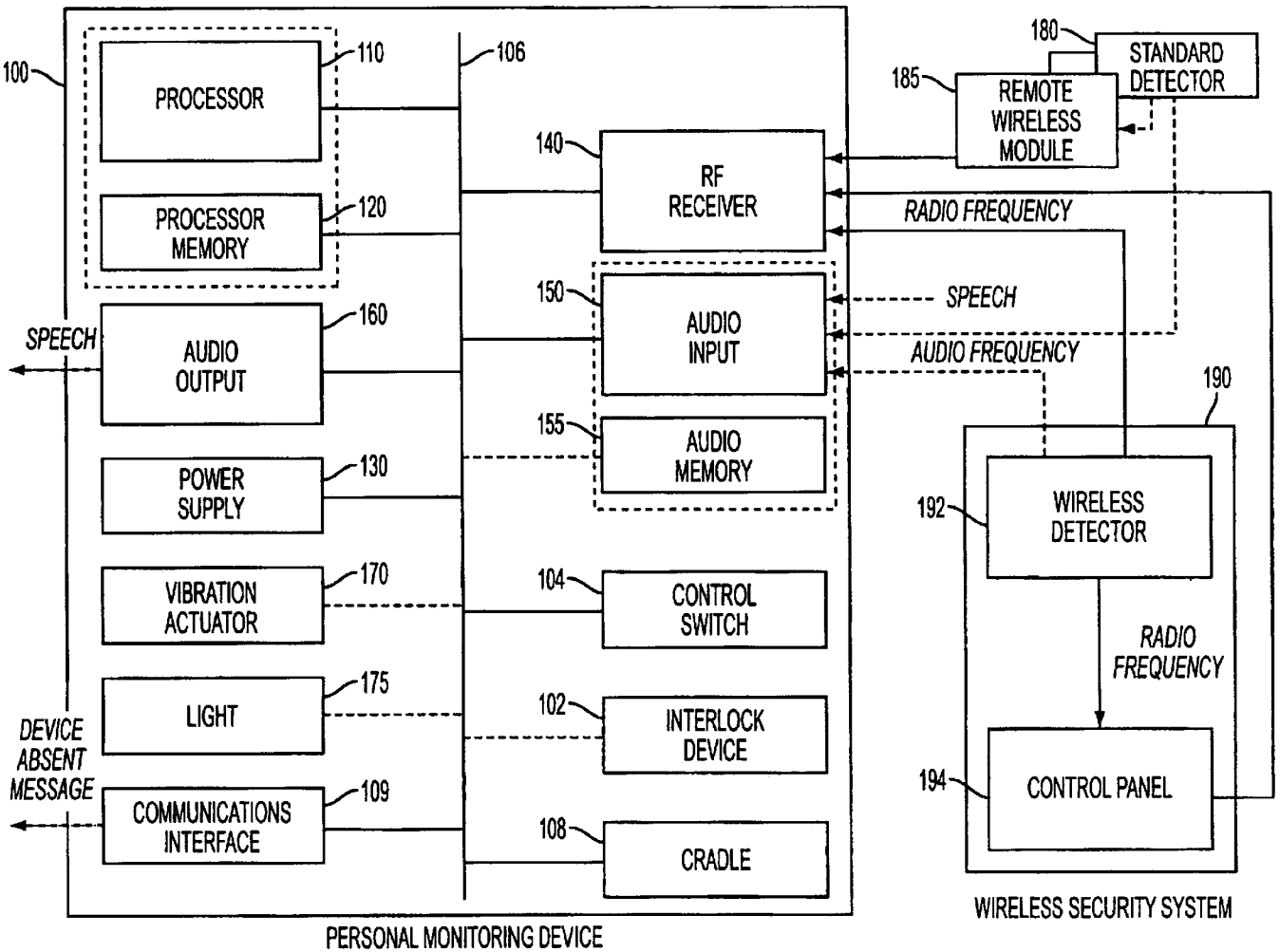
FIG. 1 is a schematic representation of a personal monitoring system, according to embodiments of the present invention.

FIG. 1 is a schematic representation of a personal monitoring system, according to embodiments of the present invention.

In an embodiment, personal monitoring device 100 may include bus 106 coupled to processor 110, processor memory 120, power supply 130, radio-frequency (RF) receiver 140, audio input 150, audio output 160, control switch 104 and cradle 108. In another embodiment, bus 106 may also be coupled to audio memory 155 and interlock device 102. Generally, bus 106 may include a plurality of couplings that provide electrical connections between the various components of personal monitoring device 100, such as point-to-point connections (e.g., printed circuit board traces, wire runs, etc.), address, data and/or control buses, etc. In one embodiment, personal alarm personal monitoring device 100 may also include vibration actuator 170, which may be coupled to bus 106. In another embodiment, personal monitoring device 100 may also include light 175, which may be coupled to bus 106. Generally, personal monitoring device 100 may be located in close proximity to, or in physical contact with, the quiescent person, and may be incorporated within various structures, such as, for example, a wristband, a stuffed animal, a pillow, a blanket, a comforter, a mattress, etc.

Processor 110 may be a microcontroller, such as a Microchip PIC16F628 Device (manufactured by Microchip Technology, Inc. of Chandler, Ariz.), a microprocessor, such as an Intel® compatible microprocessor, an Application Specific Integrated Circuit (ASIC), etc. Processor memory 120 may include non-volatile and/or volatile memory, such as, for example, Flash EPROM, EEPROM, PEROM, DRAM, SRAM, etc. In one embodiment, processor memory 120 may be a standalone device coupled to bus 106, such as an AMD Flash 29F Flash Memory Device (manufactured by AMD of Sunnyvale, Calif.), while in another embodiment, processor memory 120 may be included within processor 110 (i.e., on-chip). For example, the Microchip PIC16F268 Device includes on-chip FLASH program memory as well as on-chip EEPROM data memory. Generally, processor memory 120 may include instructions adapted to be executed by processor 110 to perform methods associated with embodiments of the present invention, and at least some portion of processor memory 120 may be write-enabled.

Generally, power supply 130 may provide DC power, at the appropriate voltages and currents, to the various components of personal monitoring device 100. In an embodiment, power supply 130 may include a rechargeable, or non-rechargeable, battery, voltage regulator, power control circuitry, power switch, etc., to provide one or more supply voltages, such as, for example, 9V, 5V, etc. For example, power supply 130 may operate on 120V AC power only, DC power only, a combination of AC and rechargeable, or non-rechargeable, DC power, etc.

Radio-frequency receiver 140 may be coupled to an antenna, and may receive and decode a radio-frequency alarm message. In one embodiment, radio-frequency receiver 140 may include an integrated, receiver-decoder module, such as, for example, a Linx RXD-418-KH Receiver/Decoder (manufactured by Linx Technologies of Grants Pass, Oreg.), etc. In response to the radio-frequency alarm message, radio-frequency receiver 140 may send an alert signal, via bus 106, to processor 110.

Audio input 150 may include a microphone and associated analog-to-digital (A/D) and digital signal processing (DSP) circuitry to capture an analog acoustic signal, e.g., voice or speech representing a personal alert message, convert the analog acoustic signal to digitized speech, and send the digitized speech, via bus 106, to processor 110. Processor 110 may then store the digitized speech in processor memory 120. Additionally, control switch 104 may be coupled to bus 106 to provide a signal to processor 110, or directly to audio input 150, to initiate the speech acquisition process. Once initiated, the speech acquisition process may extend for a predetermined time, such as, for example, 10 seconds, 20 seconds, 30 seconds, etc. Alternatively, the speech acquisition process may continue until the control mechanism is actuated a second time.

Audio output 160 may include an amplifier, speaker, digital-to-analog (D/A) converter and DSP circuitry to receive digitized speech, via bus 106 from processor 110 and processor memory 120, convert the digitized speech to an analog signal, amplify, and broadcast the analog speech signal through the speaker. Audio output 160 may also include a volume control switch, such as, for example, a thumbwheel, a rheostat, etc. In one embodiment, audio output 160 may also include a volume control interface coupled to bus 106. In another embodiment, audio output 160 may include automatic volume control to automatically increase the volume of the analog speech signal during playback, from an initial volume to a maximum volume level, over a predetermined time period. In a further embodiment, a piercing auditory alarm signal may be intermittently combined with the digitized speech signal, or, alternatively, with the analog speech signal.

In an embodiment, the functions of the A/D, DSP and D/A circuitry may be provided on a single chip or device, such as, for example, an ISD2532 Single Chip Voice Record/Playback Device (manufactured by Winbond Electronics Corp. of San Jose, Calif.), the Sanyo LC75010W Audio DSP (manufactured by SANYO Electric Co., Ltd. of Tokyo, Japan), etc. In this embodiment, audio input 150 may include the microphone and the single-chip voice record/playback device, which may include on-chip memory (e.g., audio memory 155) to store the digitized speech, while audio output 160 may include the speaker and associated amplification circuitry, which may include volume control, as noted above. Control switch 104 may be coupled to processor 110, or alternatively, directly to the single-chip voice record/playback device.

In this embodiment, the speech acquisition process may be initiated by activating control switch 104, and the analog speech signal may be input to the single-chip voice record/playback device via the microphone, converted to digitized speech and then stored in on-chip memory. When a play signal is received from processor 110 via bus 106, the single-chip voice record/playback device may retrieve and convert the digitized speech to an analog speech signal, and send the analog speech signal to audio output 160, which may broadcast the analog speech signal through the speaker. The single-chip voice record/playback device may reproduce telephone-quality voice, using, for example, 8-bit samples, an 8 kHz sampling frequency and a 3.4 kHz filter pass band. Other embodiments may reproduce higher-resolution voice using higher sampling rates, increased sampling resolution, broader filter pass bands, etc.

Additionally, interlock device 102 may be coupled to processor 110 (or, e.g., the single-chip voice record/playback device) to prevent activation of the speech acquisition process caused by accidental activation of control switch 104. Generally, interlock device 102 may be mechanical, electrical, electro-mechanical, etc. In an embodiment, interlock device 102 may be a shorting plug adapted to engage a shorting plug receptacle. When the shorting plug is engaged with the receptacle, activation of control switch 104 may trigger the speech acquisition process. Similarly, when the shorting plug is disengaged from the shorting plug receptacle, activation of control switch 104 may be prevented from triggering the speech acquisition process. Instead, when the shorting plug is disengaged from the shorting plug receptacle, activation of control switch 104 may trigger at least one playback of the stored, personal alert message.

In another embodiment, audio input 150 may include an audio-frequency receiver to detect an audible alarm signal, tone, etc. For example, audio input 150 may include an amplifier and level detection circuit, coupled to the microphone and processor 110. An audio-frequency alarm signal, such as, for example, the piercing, audible alarm emitted by standard detector 180, may be input to the microphone and provided to the amplifier and level detection circuit in audio input 150. The amplifier and level detector circuit may include, for example, a voltage level comparator, such as an NJM2406 Single Comparator, manufactured by New Japan Radio Co., Ltd. of Tokyo, Japan), an analog signal level detector integrated circuit (IC), etc. If the detected analog signal level exceeds a predetermined threshold, an alert signal may be sent to processor 110 via bus 106.

In an alternative embodiment, vibration actuator 170 may vibrate in response to a vibratory alarm signal sent, via bus 106, from processor 110. In one embodiment, vibration actuator 170 may be rigidly mounted to the housing of personal monitoring device 100, and may include an electric motor with an unbalanced shaft. In response to the vibratory alarm signal, which may be a simple voltage level, digital word, etc., the motor may spin the shaft to induce an oscillating force, i.e., a vibration, to the housing. In an alternative embodiment, vibration actuator 170 may be enclosed within a separate housing, external to personal monitoring device 100. In this embodiment, vibration actuator 170 may be coupled to personal monitoring device 100, for example, via a wire or wires, an infrared communications link, a radio communications link, etc. For wireless links, additional circuitry, and a power supply, may be included within the housing of vibration actuator 170. In one embodiment, light 175 may be a strobe light, while in another embodiment, light 175 may be a combination of a low voltage light (e.g., 4 W night light) and a strobe light.

Generally, standard detector 180 and wireless detector 192 may include the appropriate sensor(s), microcontroller(s) and power supply to detect various noxious and/or toxic gases (e.g., smoke, $CO_2$, CO, methane, propane, NOx, etc.) or dangerous conditions (e.g., heat, flame, water, etc.). Standard detector 180 may be any commercial smoke detector, such as, for example, a First Alert® (Double Sensor™ Smoke Detector (manufactured by BRK Brands, Inc. of Aurora, Ill.). Standard detector 180 may provide an alarm signal, typically in the form of a piercing audible alarm and/or flashing strobe light. Wireless detector 192 may be a wireless smoke, gas, heat and/or flame detector, similar to, for example, the Visonic MCT-423 Wireless Smoke Detector (manufactured by Visonic Ltd. of Tel-Aviv, Israel).

Wireless detector 192 may include a radio-frequency (RF) transmitter and supporting electronics to broadcast an RF alarm message within a frequency band in harmony with local regulations, such as, for example, 315 MHz, 404 MHz, 433 MHz, 900 MHz, 2.4 GHz, 5.8 GHz, etc. Other wireless transmission media may also be used, such as, for example, diffuse infra red (IR). Wireless detector 192 may operate independently, or, alternatively, wireless detector 192 may be an integrated component of wireless security system 190, such as, for example, the PowerMax™ system manufactured by Visonic Ltd. In one embodiment, wireless detector 192 may broadcast a single RF alarm message (e.g., a one shot) in response to the dangerous condition, such as, for example, a developing fire. In another embodiment, wireless detector 192 may broadcast a repetitive RF alarm message at a constant interval, such as, for example, every 10 seconds. The alarm message may be a simple sequence of bits, including a detector identifier as well as optional alarm identifier, checksum, etc., encoded, for example, in pulse width modulation format. Similar to standard detector 180, wireless detector 192 may optionally provide one or more additional alarm signals, such as, for example, a piercing audible alarm, a flashing strobe light, etc.

In one embodiment, wireless detector 192 may transmit the alarm message directly to personal monitoring device 100, while in another embodiment, wireless detector 192 may transmit an initial alarm message to wireless security system control panel 194 such as, for example, the PowerMax™ PowerCode™ Wireless Control Panel. In the latter embodiment, wireless security system control panel 194 may then transmit a final alarm message to personal monitoring device 100. In this manner, wireless security system control panel 194 may determine whether the initial alarm message received from wireless detector 192 is a false alarm based on other considerations, such as, for example, other wireless security system component indicators. Advantageously, any wireless security system alert status may trigger the transmission of the final alarm message from wireless security system control panel 194 to personal monitoring device 100.

Remote Wireless module 185 may include an RF transmitter, antenna, supporting electronics and power supply, and may be mounted within, or proximate to, standard detector 180. In an embodiment, the RF transmitter may be an integrated, transmitter-encoder module, such as, for example, a Linx TXD-418-KH Transmitter/Encoder, etc. In one embodiment, remote wireless module 185 may be coupled to the internal alarm signal of standard detector 180, and, upon detection of the internal alarm signal produced by standard detector 180, may transmit an RF alarm message to personal monitoring device 100. In another embodiment, remote wireless module 185 may be located proximate to standard detector 180 and may include appropriate audio circuitry (e.g., microphone, amplifier circuitry and level detector) to detect the piercing audible alarm signal, and, in response, transmit the RF alarm signal to personal monitoring device 100.

In an embodiment, remote wireless module 185 may also be mounted within, or proximate to, an alarm clock (not shown for clarity), and may send a unique RF alarm message to personal monitoring device 100 in response to a particular alarm signal from the alarm clock. In this embodiment, personal monitoring device 100 may capture and store multiple personal audio messages, and then playback one of the personal audio messages in response to a specific RF alarm message received from remote wireless module 185.

In another embodiment, several personal monitoring devices may receive RF alarm messages from remote wireless module 185 and the alarm clock. Through the use of a simple network addressing scheme, the RF alarm messages may be addressed to all of the personal monitoring devices, to groups of personal monitoring devices, as well as to specific personal monitoring devices. Remote wireless module 185 may include the appropriate address, and alarm message identifier, within the RF alarm message. For example, an RF alarm message may be sent to all of the personal monitoring devices at a particular time, such as, for example, a personal "wake up" alert message addressed to all of the personal monitoring devices located in the house. Or, an RF alarm message may be addressed to each individual personal alert device 100 and sent at different times. Numerous variations on this theme are clearly possible.

Cradle 108 may be coupled to processor 110 and may receive, capture, hold, lock, etc., a removable safety device, such as, for example, a flashlight, a cellular telephone, a walkie talkie, etc. A sensor, such as, for example, a switch, a socket, a magnetic sensor, an optical sensor, etc., may be provided to monitor the presence of the removable safety device within cradle 108. In one embodiment, cradle 108 may detect that the removable safety device has been removed from cradle 108, and, in response, send a safety device absent signal to processor 110. In another embodiment, cradle 108 may remove, interrupt, obstruct, etc., a safety device present signal to processor 110 to indicate that the removable safety device has been removed from cradle 108. The safety device absent signal may be an active high signal, or, alternatively, the safety device absent signal may be an active low signal. In one embodiment, the sensor may be manually actuated and maintained in an open position, or, alternatively, the sensor may be manually actuated and maintained in a closed position.

In one embodiment, the removable safety device may be locked within cradle 108, and unlocked after an alert signal has been received. The locking mechanism may be electro-mechanical, electro-magnetic, etc. In one embodiment, radio-frequency receiver 140 may send the alert signal to both processor 110 and cradle 108, via bus 106, in response to a radio-frequency alarm message. In another embodiment, radio-frequency receiver 140 may send the alert signal first to processor 110, and, if appropriate, processor 110 may then send an alert signal, or a release signal, to cradle 108 via bus 106. Similarly, audio input 150 may send an alert signal to both processor 110 and cradle 108, via bus 106, in response to an audio-frequency alarm signal. Alternatively, audio-frequency receiver 150 may send an alert signal first to processor 110, and, if appropriate, processor 110 may send then an alert signal, or a release signal, to cradle 108 via bus 106. In this manner, children may be prevented from removing, damaging, misplacing, etc., the removable safety device in the absence of an alarm condition indicated by the alert signal. In an alternative embodiment, a child-resistant release actuator, adapted to the locking mechanism, may be provided to allow the removal of the safety device by adults.

The removable safety device may include a rechargeable or non-rechargeable power supply, such as a battery. In an embodiment, cradle 108 may be coupled to power supply 130 in order to maintain, charge, recharge, etc., a rechargeable power supply within the removable safety device. Accordingly, cradle 108 and the removable safety device may have complementary electrical power interfaces. In an embodiment, processor 110 may be coupled to the electrical power interface of cradle 108, and may sense the presence of the removable safety device within cradle 108. In another embodiment, processor 110 may also control the charging of the removable safety device. In these embodiments, cradle 108 may not require an additional sensor to sense the presence of the removable safety device.

In an embodiment, the removable safety device may include an antenna, an RF transmitter (e.g., a Linx TXD-418-KH Transmitter/Encoder), and supporting electronics to broadcast an RF location message within a frequency band in harmony with local regulations, such as, for example, 315 MHz, 404 MHz, 433 MHz, 900 MHz, 2.4 GHz, 5.8 GHz, etc. Other frequencies may also be used, such as, for example, ultrasonic frequencies, audible frequencies, etc. In one embodiment, the removable safety device may include a processor, coupled to the electrical power interface, to sense the presence of a charging current provided by cradle 108. For example, when the removable safety device is present within cradle 108, the processor may sense the charge current provided by cradle 108. In another embodiment, the removable safety device may include a sensor, such as, for example a pressure switch, a magnetic sensor, etc., to sense the presence of the removable safety device within cradle 108. In this embodiment, the sensor may be coupled to directly to the RF transmitter, and may trigger the transmission of the RF location message when the removable safety device is from disengaged from cradle 108.

In another embodiment, the removable safety device may include an activation switch, coupled to the RF transmitter, which may allow transmission of the RF location message only when activated. In one embodiment, a power switch of the removable safety device may also function as an activation switch. For example, a removable flashlight may include an RF transmitter, coupled to the power switch, which transmits the RF location message as soon as the power switch is activated. In another embodiment, a separate activation switch may be provided. For example, a pressure switch, heat-sensing switch, etc., may be coupled to the RF transmitter to allow the RF location message to be transmitted only when the removable safety device is held in an individual's hand.

Of course, the removable safety device may already include an RF transmitter, such as, for example, a mobile cellular phone, a walkie-talkie, etc. In one embodiment, a mobile cellular phone may be programmed to automatically dial an emergency telephone number when removed from cradle 108. In this embodiment, an alert signal may be provided to the mobile cellular phone, through an electrical interface provided by cradle 108, to indicate the presence of an alarm condition. In response to the alert signal, the mobile cellular phone may power up to a standby mode, and then automatically dial the emergency number when removed from cradle 108. Alternatively, the RF location message may be transmitted. In another embodiment, a walkie-talkie may automatically transmit the RF location message when removed from cradle 108. A safety device having an RF transmitter, such as, for example, a flashlight, may be similarly configured to power up in response to the alert signal and then transmit the RF location message when removed from cradle 108. In this manner, the flashlight may be easily located, while still in the cradle, in low visibility conditions.

Advantageously, emergency response personnel may determine the position of the removable safety device by detecting the RF location message using multiple RF receivers, a multi-channel RF receiver with multiple antennas, a single-channel RF receiver with multiple antennas and multi-processing capabilities, etc. Any number of well know RF signal triangulation methods may be used to calculate the position of the receiver, such as, for example, signal arrival time differences, etc. In a further embodiment, the removable safety device may also include a small, low power, lightweight global positioning system (GPS) satellite receiver, such as, for example, the G8 GPS OEM Board (manufactured by Thales Navigation of Santa Clara, Calif.). In this embodiment, the GPS receiver may be coupled to the RF transmitter and may provide GPS navigation information. The RF location message may then include the actual position of the removable safety device.

Communications interface 109 may be coupled to processor 110. After processor 110 receives the safety device absent signal from cradle 108, processor 110 may then send the safety device absent signal to communications interface 109. In response, communications interface 109 may send a safety device absent message to a remote monitoring system, or service provider, indicating that the removable safety device is no longer present within cradle 108. In one embodiment, communications interface 109 may include a radio-frequency transmitter, while in another embodiment, communications interface 109 may include a wired network transceiver. In a further embodiment, communications interface 109 may be coupled to the public switched telephone network, the public land mobile network, etc., and may include an auto-dialer hardware device, or equivalent, as well as the necessary hardware and/or software, to place an automated telephone call to the remote monitoring system or service provider.

Communications interface 109 may send the safety device absent message directly to the remote monitoring system or service provider. Alternatively, communications interface 109 may send the safety device absent message to a local monitoring device, which may then relay the safety device absent message to the remote monitoring system. For example, the local monitoring device may be wireless security system control panel 194, which may relay the safety device absent message to a remote monitoring system or service provider. Alternatively, the local monitoring device may be a component of a monitored home security system, such as, for example, the Safewatch® Pro 3000 System. (manufactured by ADT Security Services, Inc. of Boca Raton, Fla.).

In another embodiment, communications interface 109 may be coupled directly to cradle 108. In this embodiment, cradle 108 may send the safety device absent signal, indicating that the safety device is no longer present in cradle 108, directly to communications interface 109. In response, communications interface 109 may send the safety device absent message to the remote monitoring system.

Figure 2:
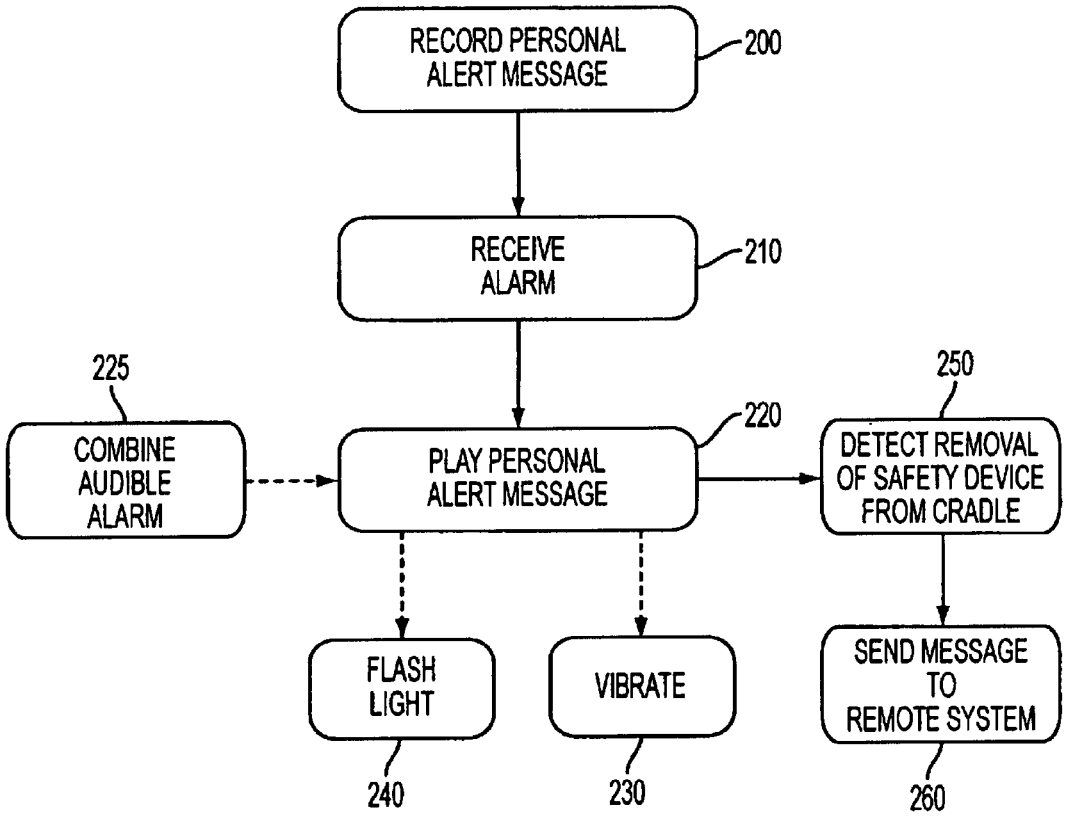
FIG. 2 is a flow chart depicting a method for alerting and monitoring a quiescent person, according to embodiments of the present invention.

FIG. 2 presents a flow chart depicting a method for alerting a quiescent person to the presence of dangerous gases, according to embodiments of the present invention.

A personal alert message may be recorded (200). In one embodiment, a spoken, personal alert message may be recorded (200) by audio input 150. In this embodiment, the spoken, personal alert message may be received and digitized by audio input 150, and then stored within audio memory 155. In another embodiment, the spoken, personal alert message may be recorded (200) by a combination of audio input 150, processor 110 and processor memory 120. In this embodiment, the spoken, personal alert message may be received and digitized by audio input 150, and then sent to processor 110 for storage within processor memory 120. Advantageously, the spoken, personal alert message may be specifically applicable, i.e., personal, to the quiescent person. For example, a person's own name occupies a privileged status in the cognitive processing of external information within the brain. In other words, the sound of a person's own name has a greater stimulating effect on the sleep/wake centers of the brain than other audible stimuli. In one embodiment, the quiescent person may be a sleeping child, and the personal alert message may be recorded by the child's parent, sibling, grandparent, guardian, etc. The personal alert message may include the child's name, and/or other important information or exhortations, such as, for example, "Johnny, Wake Up!" In another embodiment, the quiescent person may be a senior citizen, and the personal alert message may be spoken by the spouse child, relative, etc., of the senior citizen.

An alarm ma be received (210). In one embodiment, radio-frequency receiver 140 may send an alert signal to processor 110 indicating that an RF alarm message has been received (210), while in another embodiment, audio input 150 may send an alert signal to processor 110 indicating that an audio-frequency alarm signal (i.e., audible alarm) has been detected and received (210). In a further embodiment, radio-frequency receiver 140 and audio input 150 may each send alert signals to processor 110, based on the reception (210) of an radio-frequency alarm signal and an audio-frequency alarm signal, respectively. Advantageously; processor 110 may reduce the risk of false alarms by determining whether an emergency condition actually exists using various criteria, such as, for example, requiring both alert signals to be received within a predetermined time period, always requiring an alert signal from radio-frequency receiver 140, etc.

In one embodiment, processor 110 may send a play signal to audio input 150, which may convert the digitized personal alert message, stored in audio memory 155, to an analog audio signal, and then send the analog audio signal to audio output 160 to be played (220). In another embodiment, processor 110 may transfer the digitized personal alert message from processor memory 120 to audio output 160, which may then convert the digitized personal alert message to an analog audio signal. The analog audio signal may then be played (220).

In a further embodiment, a piercing, audible alarm may be combined (225) with the recorded, personal alert message. For example, a standard detector audible alarm may be temporally combined (225) with the personal alert message, so that the standard detector alarm alternates with the personal alert message. In one embodiment, the two signals may be combined (225) by audio input 150, in either the digital or analog domain, and then sent to audio output 160, while in another embodiment, the two signals may be combined (225), digitally, by processor 110 and sent to audio output 160. In a further embodiment, audio-output 160 may combine (225) the personal alert message with a standard detector alarm, in either the digital or analog domain. Generally, personal monitoring device 100 may be placed so that the quiescent person hears the personal alert message.

In another embodiment, processor 110 may also send a vibratory alarm signal to vibration actuator 170 in response to the alarm signal from radio-frequency receiver 140 or audio input 150. In response, vibration actuator 170 may vibrate (230) for a predetermined period of time, or, alternatively, until a mechanical control, such as, for example, control switch 104, is actuated on personal monitoring device 100. In a further embodiment vibration actuator 170 may be housed separately from personal monitoring device 100, and may include a mechanical control, for example, a button, a switch, etc., to cease vibration, as well as to test the vibration actuator. Vibration actuator 170 may be placed so that the quiescent person senses the vibration. For example, vibration actuator 170 may be attached to a wristband, a child's toy (e.g., a stuffed animal or teddy bear), a pillow, a bed, a mattress, etc.

In a further embodiment, processor 110 may also send a visual alarm signal to light 175 in response to the alarm signal from radio-frequency receiver 140 or audio input 150. In response, light 175 may flash (240) for a predetermined period of time, or, alternatively, until a mechanical control, such as, for example, control switch 104, is actuated on personal monitoring device 100. In another embodiment, light 175 may be housed separately from personal monitoring device 100, and may include a mechanical control, e.g., button, switch, etc., to cease activation, as well as to test the light. Light 175 may be placed so that the quiescent person senses the visual cue. For example, light 175 may be attached to a headboard, a child's toy (e.g., the eyes of a stuffed animal or teddy bear), etc.

The removal of a safety device from a cradle may be detected (250). In an embodiment, cradle 108 may include a sensor to monitor the presence or absence of a removable safety device; e.g., a flashlight, a cell phone, a walkie talkie, etc. In one embodiment, cradle 108 may detect (250) the removal of the safety device, and then send a safety device absent signal to processor 110. In response, processor 110 may send a safety device absent signal to communications interface 109. In this embodiment, processor 110 may send the safety device absent signal to communications interface 109 whenever the safety device absent signal is received from cradle 108, while in another embodiment, processor 110 may send the safety device absent signal to communications interface 109 only if the alarm has been received (210) and the personal alert message has been played (220). The latter embodiment allows the removable safety device to be used in non-emergency conditions without generating false alarms. In an alternative embodiment, cradle 108 may continuously send a safety device present signal to processor 110, which may be interrupted when cradle 108 detects (250) the removal of the safety device. In a further embodiment, cradle 108 may include an electrical power interface which may monitor the presence, charge state, etc., of the removable safety device.

In an embodiment, the presence of the removable safety device may be detected during the initial power up cycle of personal monitoring device 100, and processor 110 may send the safety device absent signal to communications interface 109 only if the removable safety device was present in cradle 108 prior to the alarm condition. Similarly, the insertion of the removable safety device into cradle 108 may also be detected, and processor 110 may send the safety device absent signal to communications interface 109 only if the removable safety device was inserted into cradle 108 prior to the alarm condition.

A message may be sent (260) to a remote monitoring system in response to detecting (250) the removal of the safety device from the cradle. In an embodiment, communications interface 109 may send (260) a safety device absent message to the remote monitoring system in response to receiving the safety device absent signal from processor 110. In another embodiment, the safety device absent signal may be received directly from cradle 108. In a further embodiment, the safety device absent signal may be received from processor 110 and cradle 108, and communications interface 109 may send (260) the safety device absent message only if both signals are received. The safety device absent message may be sent (260) over a wired network, a wireless network, a virtual private network, etc.

In a further embodiment, the audio signal may be played (220) at an initial volume level, and then the volume level may be increased to a maximum volume level over certain period of time, such as, for example, one minute, three minutes, 10 minutes, etc. Additionally, the playback of the audio signal may be stopped after the removal of the safety device from cradle 108 is detected (250). In one embodiment, audio output 160 may automatically control the volume and playback of the audio signal, while in another embodiment, audio output 160 may control the volume and playback of the audio signal based on a control signal received from processor 110, or, alternatively, audio input 150.

Several embodiments of the present invention are specifically illustrated and described herein. However, it will be appreciated that modifications and variations of the present invention are covered by the above teachings and within the purview of the appended claims without departing from the spirit and intended scope of the invention.

What is claimed is:

1. A method for alerting and monitoring a quiescent person, comprising:

recording a personal alert message; and in response to receiving an alarm:

playing the personal alert message, and in response to detecting the removal of a safety device from a cradle, sending a message to a remote monitoring system.

2. The method of claim 1, further comprising:

locking the safety device in the cradle; and in response to receiving the alarm, unlocking the safety device.

3. The method of claim 1, further comprising:

transmitting a radio-frequency location signal from the safety device to at least one radio-frequency receiver; and determining a position of the safety device based on the radio-frequency location signal.

4. The method of claim 1, wherein said playing the personal alert message includes:

playing the personal alert message at an initial volume; and increasing the initial volume to a maximum volume over a predetermined time period.

5. The method of claim 1, wherein the alarm is an alarm message received over a radio-frequency communications link.

6. The method of claim 1, wherein the alarm is an audible alarm received over an audio-frequency communications link.

7. The method of claim 1, wherein the safety device absent message is sent over a wired network.

8. The method of claim 1, wherein the safety device absent message is sent over a wireless network.

9. The method of claim 1, wherein the safety device is at least one of a flashlight, a mobile cellular phone, and a walkie-talkie.

10. A system for alerting and monitoring a quiescent person, comprising:

a cradle to:

transmit a safety device absent signal in response to the removal of a safety device;

a communications interface to:

send a safety device absent message, to a remote monitoring system, in response to the safety device absent signal;

an audio input to:

record a personal alert message, playback the personal alert message in response to a play signal, and transmit an alert signal in response to the detection of an audible alarm;

an audio output, coupled to the audio input, to:

play the personal alert message, received from the audio input, through a speaker; and a processor, coupled to the cradle, the communications interface, the audio input, the audio output, and a power supply, the processor adaptively configured to:

transmit the play signal in response to the alert signal, and transmit the safety device absent signal, to the communications interface, in response to the alert signal from the audio input and the safety device absent signal from the cradle.

11. The system of claim 10, wherein the communications interface is coupled to the cradle to receive the safety device absent signal from the cradle.

12. The system of claim 10, wherein the cradle is coupled to the power supply and includes an electrical power interface to the safety device.

13. The system of claim 12, wherein the processor is further adapted to control the charging of the safety device.

14. The system of claim 10, further comprising:

a radio-frequency receiver, coupled to the processor, to send the alert signal to the processor in response to a radio-frequency alarm.

15. The system of claim 10, wherein the removable safety device is a flashlight.

16. The system of claim 10, wherein the removable safety device is a cellular telephone.

17. The system of claim 10, wherein the removable safety device is a walkie talkie.

18. The system of claim 10, wherein:

the cradle includes a locking mechanism to:

lock the safety device in the cradle; and in response to the alert signal, unlock the safety device; and the processor is further adapted to transmit the alert signal to the cradle.

19. The system of claim 10, wherein the cradle is coupled to the audio input and includes a locking mechanism to:

lock the safety device in the cradle; and in response to the alert signal, unlock the safety device.

20. The system of claim 14, wherein the cradle is coupled to the radio-frequency receiver and includes a locking mechanism to:

lock the safety device in the cradle; and in response to the alert signal, unlock the safety device.

21. The system of claim 10, wherein the safety device includes a radio-frequency transmitter to transmit a radio-frequency location signal.

22. The system of claim 21, further comprising at least one radio-frequency receiver to:

receive the radio-frequency location signal; and determine a position of the safety device based on the radio-frequency location signal.

23. The system of claim 22, wherein the safety device includes a global positioning system receiver coupled to the radio-frequency transmitter.

24. The system of claim 23, wherein the radio-frequency location signal includes global positioning system navigation information.

25. The system of claim 10, wherein the audio output is adapted to play the personal alert message at an initial volume; and increase the initial volume to a maximum volume over a predetermined time period.

26. A system for alerting and monitoring a quiescent person, comprising:

a charging cradle to:

transmit an alert signal to a removably coupled cellular phone, the cellular phone adaptively configured to:

power up in response to the alert signal, and automatically dial a predetermined phone number when removed from the cradle;

an audio input, coupled to the charging cradle, to:

record a personal alert message, play the personal alert message through an audio output in response to a play signal, and transmit the alert signal in response to detecting an audible alarm;

a processor, coupled to the charging cradle, the audio input and a power supply, the processor adaptively configured to transmit the play signal in response to the alert signal.

27. A system for alerting and monitoring a quiescent person, comprising:

a charging cradle to:

transmit an alert signal to a removably coupled safety device, the safety device adaptively configured to:

power up in response to the alert signal, and automatically transmit a radio-frequency location signal when removed from the cradle;

an audio input, coupled to the charging cradle, to:

record a personal alert message, play the personal alert message through an audio output in response to a play signal, and transmit the alert signal in response to detecting an audible alarm;

a processor, coupled to the charging cradle, the audio input and a power supply, the processor adaptively configured to transmit the play signal in response to the alert signal.

28. The system of claim 27, wherein the safety device is a walkie-talkie.

29. The system of claim 27, wherein the safety device is a flashlight having a radio-frequency transmitter.

* * * * *